US007686295B2

(12) United States Patent
Kawaguchi et al.

(10) Patent No.: US 7,686,295 B2
(45) Date of Patent: Mar. 30, 2010

(54) PAPER EJECTING DEVICE

(75) Inventors: Akira Kawaguchi, Wakayama (JP); Katsunori Takahashi, Wakayama (JP); Nobuki Tanimoto, Wakayama (JP)

(73) Assignee: Duplo Seiko Corporation, Wakayama (JP)

( * ) Notice: Subject to any disclaimer, the term of this patent is extended or adjusted under 35 U.S.C. 154(b) by 0 days.

(21) Appl. No.: 12/357,475

(22) Filed: Jan. 22, 2009

(65) Prior Publication Data

US 2009/0212484 A1 Aug. 27, 2009

(30) Foreign Application Priority Data

Feb. 26, 2008 (JP) ..... 2008-043676

(51) Int. Cl.
*B65H 29/70* (2006.01)

(52) U.S. Cl. ..... 271/188; 271/209

(58) Field of Classification Search ..... 271/209, 271/188, 276, 197
See application file for complete search history.

(56) References Cited

U.S. PATENT DOCUMENTS

| | | | | |
|---|---|---|---|---|
| 2,381,430 | A * | 8/1945 | Belluche | 271/183 |
| 5,975,521 | A * | 11/1999 | Ono et al. | 271/188 |
| 6,497,522 | B2 * | 12/2002 | Wotton et al. | 400/578 |
| 6,581,928 | B1 * | 6/2003 | Stephan | 271/188 |
| 6,701,841 | B2 * | 3/2004 | Tsurumaki | 101/419 |
| 7,300,051 | B1 * | 11/2007 | Rieschick | 271/188 |

* cited by examiner

*Primary Examiner*—Kaitlin S Joerger
(74) *Attorney, Agent, or Firm*—Fildes & Outland, P.C.

(57) ABSTRACT

Curling of a printed sheet is corrected, friction is reduced on a paper transport surface, and the shape of the printed and ejected sheet is adjusted to a predetermined shape.

10 Claims, 7 Drawing Sheets

PAPER EJECTING DEVICE

FIELD OF THE INVENTION

The present invention relates to a paper ejecting device for ejecting sheets of paper from a machine such as a stencil duplicator to a paper receiving tray and the like, and relates to a technique for correcting curling of the sheets during ejection.

BACKGROUND OF THE INVENTION

In the prior art, water-in-oil emulsion ink containing oil components has been mainly used for stencil duplicators and water based ink containing few oil components has been mainly used for ink-jet printers.

Unfortunately, in printers using such liquid ink, so-called curling occurs unlike in copiers for performing heat fusing with powder toner. In other words, when liquid ink is printed on a surface of a sheet during printing, the moisture of the ink quickly penetrates into the sheet from the surface and thus rolling, that is, curling rapidly occurs on the printed sheet.

During single-sided printing, a printed sheet is generally rolled from a surface on which liquid ink is printed to the opposite surface. Thus when the printed sheet is ejected to a paper receiving tray with the printed surface directed upward, the sheet is curled into a reversed U-shape from the front side, which is directed upward, to the back side.

During double-sided printing, the printed sheet is rolled from a surface having a large print rate to the other surface having a small print rate. Thus during the ejection of the printed sheet to the paper receiving tray, the printed sheet is curled downward into a reversed U-shape from the front side, which is directed upward, to the back side of the sheet when the front side has a higher surface print rate. The printed sheet is curled upward into a U-shape from the back side, which is directed downward, to the front side of the sheet when the back side has a higher print rate.

In a stencil duplicator of the prior art, printed sheets of paper are transported by a paper suction transport belt and are ejected from a paper ejecting device to a paper receiving tray according to a typical technique. The paper ejecting device includes so-called jumping boards for adjusting the shape of a printed and ejected sheet, which jumps from the paper ejecting device to the paper receiving tray, to a predetermined shape. With the jumping boards, the shape of the printed sheet is curved so as to raise the sheet ends provided in parallel with an axis disposed along a jumping direction.

Thus when the printed sheet is curled into a reversed U-shape (downward), the printed sheet is sucked by the paper suction transport belt and the surfaces of the printed sheet are shaped along a paper transport surface, so that curling of the sheet can be corrected. Moreover, with the jumping boards of the paper ejecting device, curling of the printed sheet is inverted and corrected and the shape of the printed and ejected sheet can be adjusted to a predetermined shape.

Although the center of the printed sheet is sucked by the paper suction transport belt in the paper ejecting device, the jumping boards have no air suckers. For this reason, even when curling of the sheet can be substantially corrected by sucking the center of the printed sheet by the paper suction transport belt and the surfaces of the sheet are shaped along the paper transport surface, sheets may be misaligned on the paper receiving tray depending on the kind of paper. In other words, parts around the sheet ends may rise from the paper transport surfaces of the jumping boards in a state in which the sheet ends are in contact with the paper transport surfaces of the jumping boards, so that curling may slightly remain around the sheet ends. Since curling cannot be positively corrected, the shape of the printed and ejected sheet cannot be adjusted to the predetermined shape, so that sheets are misaligned on the paper receiving tray.

When the printed sheet is curled into a U-shape (upward), the surfaces of the printed sheet cannot be shaped along the paper transport surfaces only by sucking the printed sheet by the paper suction transport belt.

Such a paper ejecting device is described in, for example, Japanese Patent Laid-Open No. 2007-246181 and Japanese Patent Laid-Open No. 2001-18512. In Japanese Patent Laid-Open No. 2007-246181, a paper transport unit for transporting sheets by air suction includes paper stiffness plates (corresponding to the jumping boards) for providing stiffness for a printed sheet which is ejected from a printer, and the paper transport surfaces of the paper stiffness plates have air suction holes for sucking the sheet on the transport surfaces.

In this invention, when the printed sheet is curled into a reversed U-shape (downward), a sheet surface opposed to the paper stiffness plate is sucked and thus both ends of the printed sheet are shaped along the paper transport surfaces of the paper stiffness plates, so that curling can be corrected.

In the foregoing configuration, however, a force applied to the printed sheet by air suction presses the surface of the printed sheet to the paper transport surfaces of the paper stiffness plates and thus friction between the surface of the printed sheet and the paper transport surfaces of the paper stiffness plates becomes a transport resistance. For this reason, depending on the kind of paper, for example, a thin sheet having low stiffness may be wrinkled.

Also in the foregoing configuration, when the printed sheet is curled into a U-shape (upward), a suction force of air suction does not effectively act on the surface of the printed sheet which is opposed to the paper stiffness plates, so that both ends of the printed sheet cannot be shaped along the paper transport surfaces of the paper stiffness plates.

The present invention has been devised to solve the problems. An object of the present invention is to provide a paper ejecting device which can positively correct curling, reduce friction on a paper transport surface to obtain smooth ejection, and adjust the shape of a printed and ejected sheet to a predetermined shape when the printed sheet is curled into a reversed U-shape (downward) and when the printed sheet is curled into a U-shape (upward).

DISCLOSURE OF THE INVENTION

In order to solve the problems, a paper ejecting device of the present invention includes a body having suction transport belts for transporting a sheet of paper along the paper transport surface of the body by suction; jumping boards provided on both sides of the body along a paper transport direction; and a curling corrector for correcting the shape of the sheet along the paper transport surfaces of the jumping boards.

Moreover, the jumping board has a friction reducer on the paper transport surface, the friction reducer reducing friction with the sheet.

Further, the curling corrector is made up of a sucker for sucking the sheet on the paper transport surface of the jumping board.

Moreover, the friction reducer is made up of a low-friction member composing the paper transport surface of the jumping board.

Further, the friction reducer is made up of a plurality of protrusions formed on the paper transport surface of the jumping board or is made up of concave and convex portions formed on the paper transport surface of the jumping board.

Moreover, the friction reducer is made up of a plurality of ribs formed on the paper transport surface of the jumping board along the paper transport direction.

Further, the friction reducer is made up of a plurality of rollers provided on the paper transport surface of the jumping board.

Moreover, the friction reducer is made up of a suction transport belt for transporting the sheet along the paper transport surface of the suction transport belt by suction.

Further, the curling corrector is made up of an air blower for blowing air so as to press the sheet to the paper transport surfaces of the jumping boards.

Moreover, the air blower blows air from the center of the sheet to both ends of the sheet, the ends being disposed in parallel with the paper transport direction.

Further, the body and the friction reducer can adjust the transport speeds of the suction transport belts.

Moreover, in the curling corrector, the sucker is made up of an air sucker capable of adjusting an air suction force.

Further, the jumping board has the paper transport surface which can be tilted at any angle relative to the paper transport surface of the body and can be moved to any position in a direction orthogonal to the paper transport direction.

As has been discussed, according to the present invention, a curling corrector corrects the shape of a sheet along the paper transport surfaces of jumping boards, so that both ends of the sheet can be prevented from being raised and the shape of the ejected sheet can be adjusted to a predetermined shape.

At this point, a friction reducer reduces friction with the sheet on the paper transport surfaces of the jumping boards, so that friction between a surface of the sheet and the paper transport surfaces does not become a transportation resistance. For example, even a thin sheet having low stiffness can be ejected with a predetermined shape without being wrinkled.

The curling corrector can be realized by one of a sucker for sucking the sheet on the paper transport surfaces of the jumping boards and an air blower for blowing air so as to press the sheet to the paper transport surfaces of the jumping boards, and both of the sucker and the air blower can be used at the same time.

The sucker can be realized by one of air suction and electrostatic attraction. The air blower locally blows air from the center of the sheet to the sheet ends provided on both sides in parallel with the paper transport direction, so that the sheet ends on both sides are pressed to the paper transport surfaces of the jumping boards so as to correct the shape of the sheet along the paper transport surfaces of the jumping boards and it is possible to prevent air from blowing to unnecessary points.

Further, the transport speeds of suction transport belts can be adjusted, the sucker is made up of an air sucker capable of adjusting an air suction force, and the jumping board has the paper transport surface which can be tilted at any angle relative to the paper transport surface of the body and can be moved to any position in a direction orthogonal to the paper transport direction. Thus even for varying kinds of paper, the shapes of ejected sheets can be stabilized by various condition settings.

DESCRIPTION OF THE EMBODIMENTS

Embodiments of the present invention will be described below in accordance with the accompanying drawings. The following will first describe a printer using a paper ejecting device of the present invention, with reference to the accompanying drawings.

Figure 11:
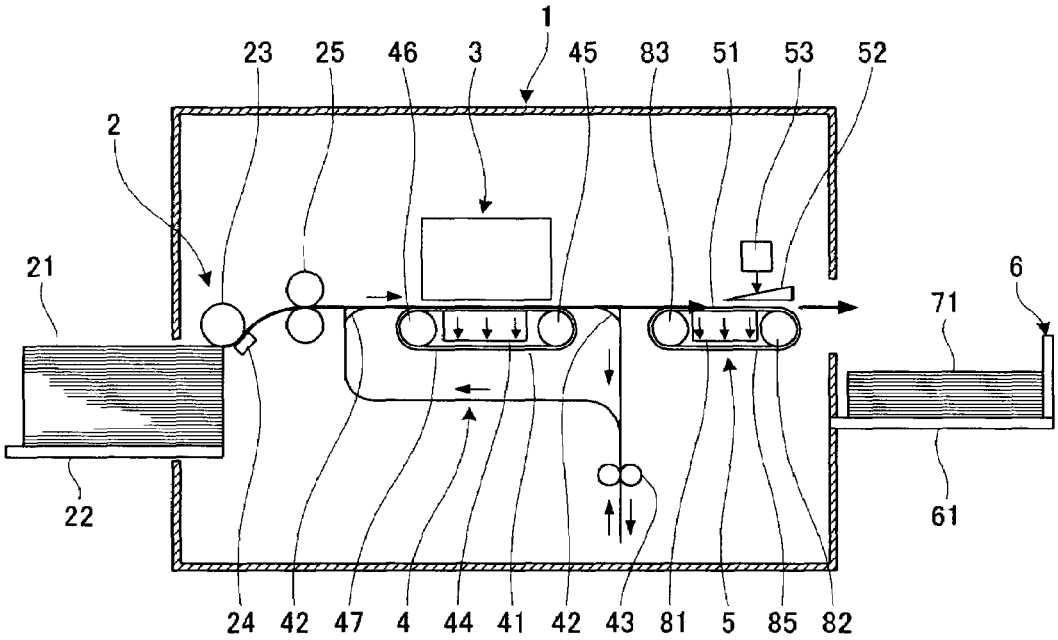
FIG. 11 is a schematic view showing the configuration of an ink-jet printer.
Figure 12:
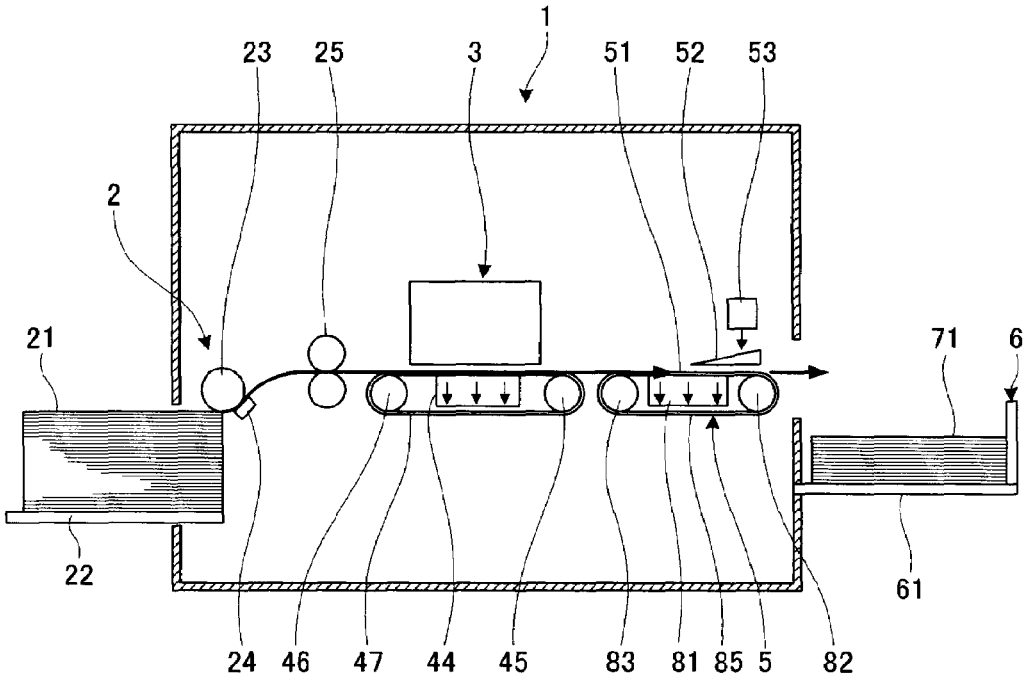
FIG. 12 is a schematic view showing another configuration of the ink-jet printer.

In the following explanation, an ink-jet printer will be illustrated as an application of the paper ejecting device of the present invention. The paper ejecting device of the present invention is also applicable to a stencil duplicator, a screen printer, and so on. The ink-jet printer may be configured both for single-sided and double-sided printing as shown in FIG. 11 or may be configured only for single-sided printing as shown in FIG. 12. In the following explanation, the ink-jet printer will be described with reference to FIG. 11. The configurations of FIG. 12 are indicated by the same reference numerals as in FIG. 11 and the explanation thereof is omitted.

In FIG. 11, an ink-jet printer 1 is made up of a paper feed mechanism 2, a printer body 3, a paper transport mechanism 4, a paper ejecting device 5, and a paper receiving mechanism 6.

The paper feed mechanism 2 includes a feed tray 22 for loading sheets 21, a feed roller 23 and a feed pad 24 which transport the sheets 21 one by one from the feed tray 22, and a plurality of upper and lower transport rollers 25 in pairs for supplying the transported sheets 21 to the printer body 3.

In this case, the printer body 3 performs printing by spraying water based ink onto a sheet surface according to an ink-jet printing system.

In the paper transport mechanism 4, a transport path is formed by a combination of a plurality of transport units 41, gates 42, and a pair of reversing rollers 43. To avoid complication in the drawing, only the transport unit 41 corresponding to the printer body 3 is shown. The gates 42 are disposed at the branch points and junctions of the transport path made up of the plurality of transport units 41, and the transport path is switched by operating the gates 42.

The transport unit 41 includes a suction box 44 communicating with a suction source, a pair of a driving roller 45 and a driven roller 46 which are disposed at the front and rear of the suction box 44, and a paper suction transport belt 47 looped over the rollers 45 and 46 at the front and rear. The sheets 21 are transported on the upper surface of the paper suction transport belt 47 by sucking air through a plurality of holes formed on the suction box 44 and the paper suction transport belt 47.

The paper receiving mechanism 6 includes a paper receiving tray 61 for receiving printed sheets 71 which are ejected from the paper ejecting device 5.

The paper ejecting device 5 transports the printed sheets 71 by sucking air and includes a body 51, jumping boards 52 disposed on both sides of the body 51, and an air blower 53 for blowing air to the paper transport surfaces of the jumping boards 52 with a fan and the like. The air blower 53 blows air from the center to both sides of a sheet.

As shown in FIGS. 1 to 5, the body 51 includes a suction box 81 communicating with the suction source, drive rollers 82 and driven rollers 83 which are disposed in pairs at the front and rear of the suction box 81, a drive shaft 84, and paper suction transport belts 85 looped over the rollers 82 and 83 at the front and rear.

Two pairs of the rollers 82 and 83 and the paper suction transport belts 85 are disposed in parallel with each other and the single drive shaft 84 simultaneously drives the paper suction transport belts 85 on the right and left. The printed sheets 71 are transported on the upper surfaces of the paper suction transport belts 85 by sucking air through a plurality of holes formed on the suction box 81 and the paper suction transport belts 85.

The jumping boards 52 each include a suction box 91 which acts as a sucker and communicates with the suction source, a pair of a drive roller 92 and a driven roller 93 which are disposed at the front and rear of the suction box 91, a drive shaft 94, a paper suction transport belt 95 looped over the rollers 92 and 93 at the front and rear, a tilted guide plate 96 and an expanded guide plate 97 which compose a paper transport surface, and a universal joint 98 provided at a point on the drive shaft 94.

The expanded guide plate 97 rotatively holds the drive shaft 94 and the drive shaft 94 slidably fits into a hole 84*a* of the drive shaft 84 of the body 51 in an axial direction. The drive shaft 94 of the jumping board 52 and the drive shaft 84 of the body 51 are engaged with a key 94*a* around the axis, and the key 94*a* slides with the drive shaft 94 of the jumping board 52 in the axial direction while being engaged with a key groove 84*b* formed in the hole 84*a* of the drive shaft 84 of the body 51.

With this configuration, the jumping board 52 can slide in the axial direction of the drive shaft 84 of the body 51, that is, the jumping board 52 can move to any position in a direction orthogonal to a paper transport direction.

The tilted guide plate 96 is connected via a hinge 99 so as to be vertically tilted at any angle relative to the expanded guide plate 97. The tilting axis of the hinge 99 is disposed in parallel with the paper transport direction. However, the tilting axis of the hinge 99 may be disposed not in parallel with the paper transport direction and the configuration will be described later.

In the jumping board 52, the drive shaft 94 rotates in synchronization with the drive shaft 84 of the body 51, the paper suction transport belt 95 is driven in synchronization with the paper suction transport belts 85 of the body 51, and the printed sheet 71 is transported on the upper surface of the paper suction transport belt 95, which composes a part of the paper transport surface, by sucking air through a plurality of holes formed on the suction box 91 and the paper suction transport belt 95.

In the paper ejecting device 5, adjustments can be made according to the kind of paper as follows: the air suction forces of the suction boxes 81 and 91 can be adjusted, for example, by controlling the number of revolutions of a fan in the suction source, the transport speeds of the paper suction transport belts 85 and 95, that is, the transport speed of a sheet can be adjusted by controlling the number of revolutions of the drive shafts 84 and 94, the angle of the jumping board 52 can be adjusted by tilting the hinge 99, and the pitch of the jumping board 52 can be adjusted by sliding the drive shafts 84 and 94.

The paper ejecting device 5 of the present embodiment includes a curling corrector which is the suction box 91 for sucking the printed sheet 71 and a curling corrector which is the air blower 53 for blowing air to the paper transport surfaces of the jumping boards 52. Only one of the curling correctors may be provided or a transport belt of an electrostatic attraction type may be used instead of the suction box 91 and the paper suction transport belt 95.

The following will describe the transport path of sheets in the printer of the present invention.

(Single-Sided Printing)

As shown in FIG. 11, the paper feed mechanism 2 feeds the sheets 21 one by one to the printer body 3. The transport unit 41 transports the sheet 21 by suction through the paper suction transport belt 47, and the printer body 3 performs printing on one surface of the sheet 21. The printed sheet 71 is transferred from the transport unit 41 to the paper ejecting device 5, and the paper ejecting device 5 transports the printed sheet 71 by suction through the paper suction transport belts 85 and 95 and ejects the printed sheet 71 to the paper receiving tray 61.

During single-sided printing, the printed sheet 71 may be rolled from a surface printed with liquid ink to the opposite surface. Thus when the printed sheet 71 is ejected to the paper receiving tray 61 with the printed surface directed upward, the printed sheet 71 may be curled downward into a reversed U-shape from the front side, which is directed upward, to the back side.

In this printer, the printed sheet 71 is sucked on the upper surfaces of the paper suction transport belts 85 of the body 51 and the upper surfaces of the paper suction transport belts 95 of the jumping boards 52 in the paper ejecting device 5. Thus the surfaces of the printed sheet 71 are shaped along the paper transport surface on the upper surface of the suction box 81 of the body 51 and the paper transport surfaces on the upper surfaces of the tilted guide plates 96 and the expanded guide plates 97 of the jumping boards 52, so that curling of the printed sheet 71 can be corrected.

Further, the paper transport surface of the tilted guide plate 96 of the jumping board 52 is inclined at a predetermined angle relative to the paper transport surface of the body 51. Thus curling of the printed sheet 71 is inverted and corrected and the printed sheet 71 is curved so as to raise the sheet ends provided in parallel with an axis disposed along a jumping direction, so that the shape of the printed and ejected sheet 71 can be adjusted to a predetermined shape.

In this case, the suction box 91 of the jumping board 52 composes the curling corrector. Curling can be more properly corrected by adjusting the air suction forces of the suction boxes 81 and 91, the transport speeds of the paper suction transport belts 85 and 95, the angle of the jumping board 52, and the pitch of the jumping board 52 according to the kind of paper.

Further, in the paper ejecting device 5 of the present embodiment, the paper suction transport belts 95 moving with a sheet realize a friction reducer for reducing friction on the paper transport surfaces of the jumping boards 52. In other words, a force applied to the printed sheet 71 by air suction acts as a force which presses the surface of the printed sheet 71 to the paper suction transport belts 95 composing a part of the paper transport surface but does not press the surface of the printed sheet 71 to the other paper transport surface of the tilted guide plate 96. Thus friction between the surface of the printed sheet 71 and the paper transport surface is small and does not become a transport resistance, so that wrinkles do not occur even when the printed sheet 71 is, for example, a thin sheet having low stiffness.

The friction reducer may be realized by other configurations, which will be described later.

(Double-Sided Printing)

As shown in FIG. 11, the paper feed mechanism 2 feeds the sheets one by one to the printer body 3. The transport unit 41 transports the sheet 21 by suction through the paper suction transport belt 47, and the printer body 3 performs printing on one surface of the sheet 21.

After printing in the printer body 3, the printed sheet 71 is inverted in the paper transport mechanism 4 and then is returned to the feed port of the printer body 3. For this inversion, the gate 42 disposed between the paper ejecting device 5 and the transport unit 41 immediately below the printer body 3 is operated to temporarily feed the printed sheet 71 to the pair of reversing rollers 43, and then the reversing rollers 43 are reversely operated to feed the printed sheet 71 to the transport unit 41 composing a return path. After that, the gate 42 disposed between the transport rollers 25 and the transport unit 41 immediately below the printer body 3 is operated to feed back the printed sheet 71 to the feed port of the printer body 3.

The transport unit 41 transports the printed sheet 71 by suction through the paper suction transport belt 47, and the printer body 3 performs printing on the back side of the printed sheet 71. The printed sheet 71 is transferred from the transport unit 41 to the paper ejecting device 5, and the paper ejecting device 5 transports the printed sheet 71 by suction through the paper suction transport belts 85 and 95 and ejects the printed sheet 71 to the paper receiving tray 61.

During double-sided printing, the printed sheet may be rolled from a surface having a large print rate to the other surface having a small print rate. Thus during the ejection of the printed sheet 71 having undergone double-sided printing to the paper receiving tray 61, the printed sheet 71 may be curled downward into a reversed U-shape from the front side, which is directed upward, to the back side of the sheet when the front side has a higher surface print rate. The printed sheet 71 may be curled upward into a U-shape from the back side, which is directed downward, to the front side of the sheet when the back side has a higher print rate.

In this printer, the printed sheet 71 is sucked on the upper surfaces of the paper suction transport belts 85 of the body 51 and the upper surfaces of the paper suction transport belts 95 of the jumping boards 52 in the paper ejecting device 5. Thus the surfaces of the printed sheet 71 are shaped along the paper transport surface on the upper surface of the suction box 81 of the body 51 and the paper transport surfaces on the upper surfaces of the tilted guide plates 96 and the expanded guide plates 97 of the jumping boards 52, so that curling of the printed sheet 71 can be corrected.

Thus during double-sided printing, air is blown from the air blower 53 to press both ends of the printed sheet 71 to the paper transport surfaces of the tilted guide plates 96 of the jumping boards 52, so that both ends of the sheet are forcibly expanded to the outside and are corrected along the paper transport surfaces of the jumping boards 52 and the printed sheet 71 is further sucked in air suction through the suction boxes 91 of the jumping boards 52.

Air from the air blower 53 is locally blown from the center to both ends of the printed sheet 71. Thus it is possible to prevent air from blowing to unnecessary points and efficiently correct curling.

Therefore, curling of the printed sheet 71 can be positively corrected even when the printed sheet 71 is curled upward into a U-shape as well as when the printed sheet 71 is curled downward into a reversed U-shape.

However, the curling corrector of the present invention is effective particularly when the printed sheet 71 is curled into a reversed U-shape. Thus it is preferable that a controller (not shown) determines print rates on both surfaces of the sheet 21 before printing and the sheet 21 is printed after image data is exchanged between both surfaces of the sheet 21 such that the surface having a higher print rate is directed upward when the sheet 21 is ejected to the paper ejecting device 5.

In the present embodiment, the curling corrector obtained by air suction of the suction box 91 and the curling corrector obtained by air blowing from the air blower 53 are combined. However, the printed sheet 71 can be corrected only by blowing air from the air blower 53 without air suction of the suction box 91.

As in one-sided printing, the paper transport surfaces of the tilted guide plates 96 of the jumping boards 52 are each inclined at a predetermined angle relative to the paper transport surface of the body 51. Thus curling of the printed sheet 71 is inverted and corrected, and the printed sheet 71 is curved so as to raise the sheet ends provided in parallel with the axis disposed along the jumping direction, so that the shape of the printed and ejected sheet 71 can be adjusted to the predetermined shape.

As has been discussed, in the present embodiment, the tilted guide plate 96 is connected via the hinge 99 so as to be vertically tilted relative to the expanded guide plate 97. The tilting axis of the hinge 99 is disposed in parallel with the paper transport direction. However, as shown in FIGS. 6 and 7, the tilting axis of the tilted guide plate 96 and the expanded guide plate 97 can be disposed so as to form a predetermined angle relative to the paper transport direction and the tilting axis of the hinge 99 is disposed not in parallel with the paper transport direction.

In this case, when the tilted guide plate 96 is tilted upward, the height of the end of the tilted guide plate 96 is increased toward the leading end in the paper transport direction. Thus curling of the printed sheet 71 can be inverted and corrected, and the printed sheet 71 can be smoothly curved so as to raise the sheet ends provided in parallel with the axis disposed along the jumping direction.

Figure 1:
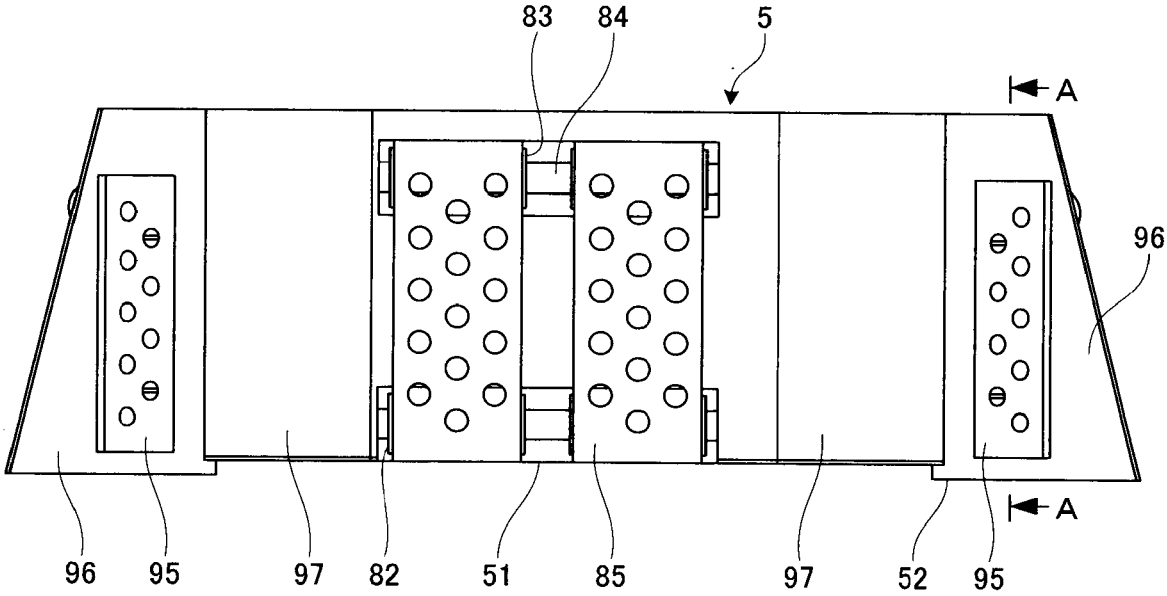
FIG. 1 is a plan view showing a paper ejecting device according to an embodiment of the present invention.
Figure 2:
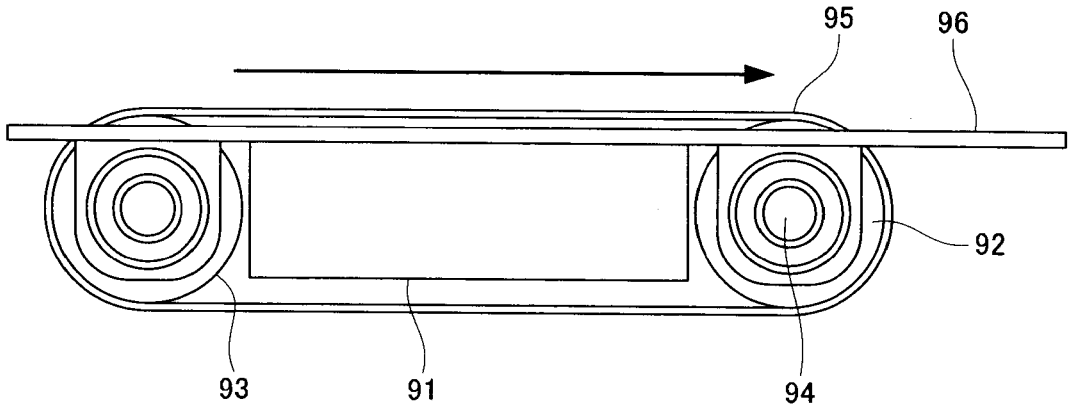
FIG. 2 is a sectional view taken along line A-A of FIG. 1.
Figure 3:
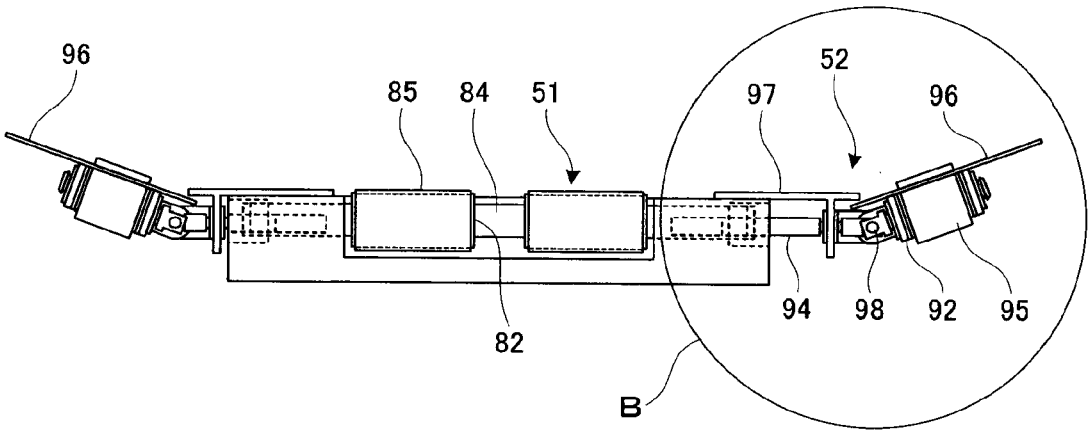
FIG. 3 is a front view of FIG. 1.
Figure 4:
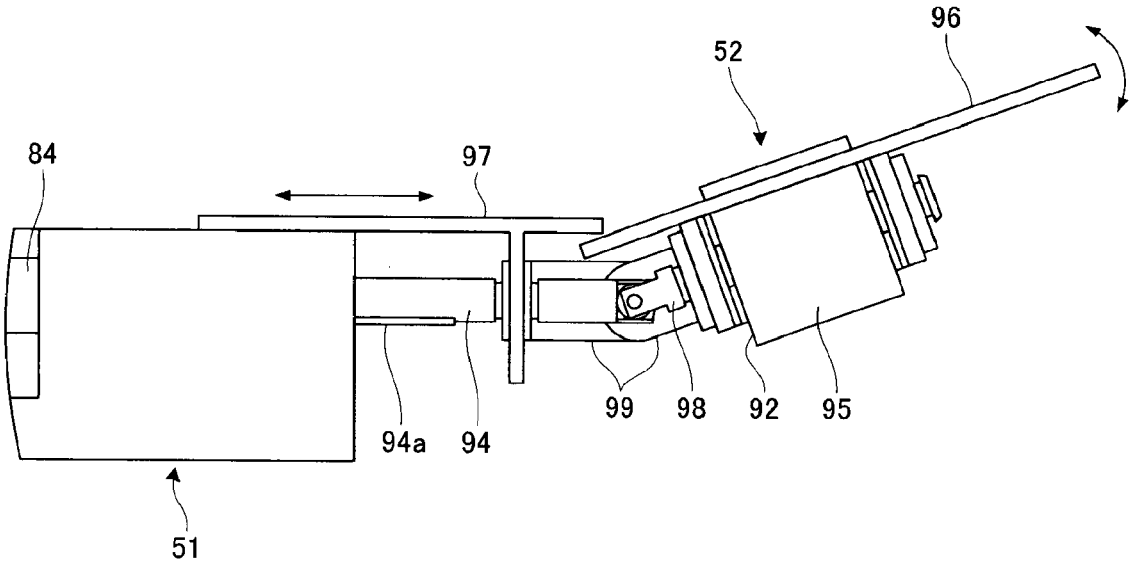
FIG. 4 is an enlarged view of part B shown in FIG. 3.
Figure 5:
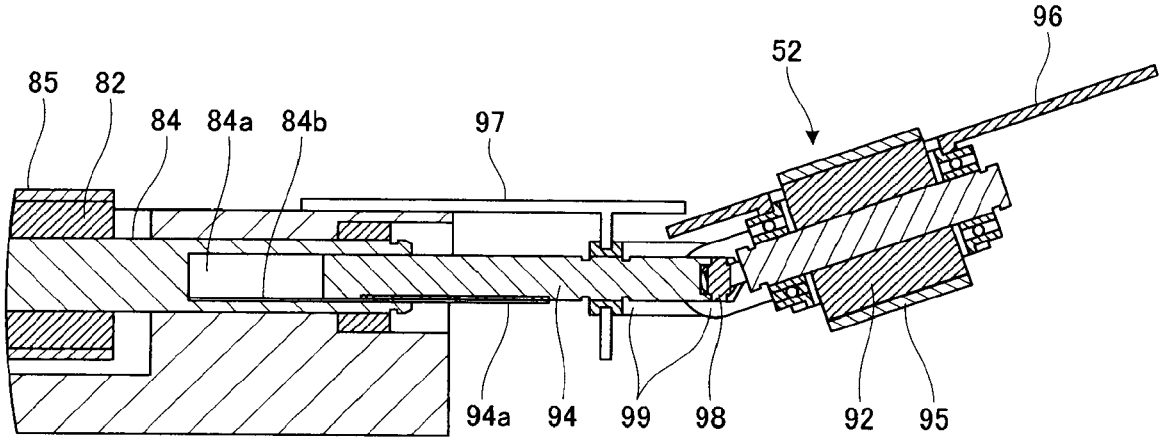
FIG. 5 is a sectional view of FIG. 4.
Figure 6:
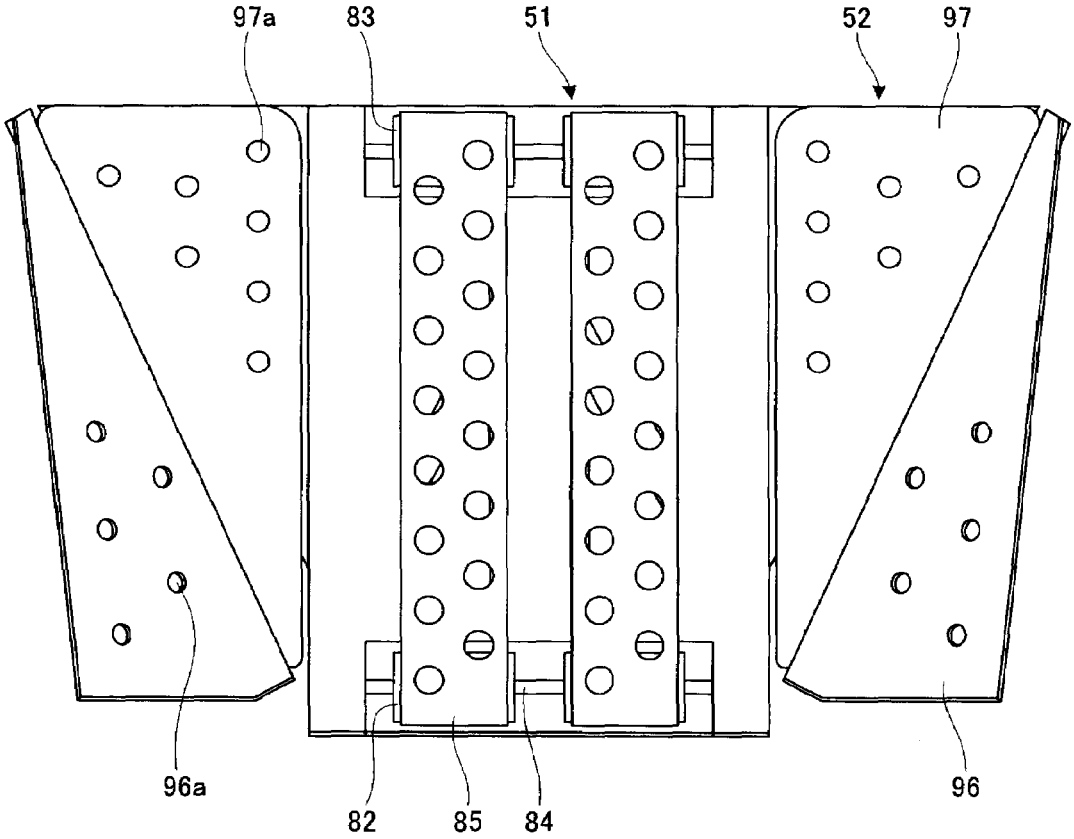
FIG. 6 is a plan view showing a paper ejecting device according to another embodiment of the present invention.
Figure 7:
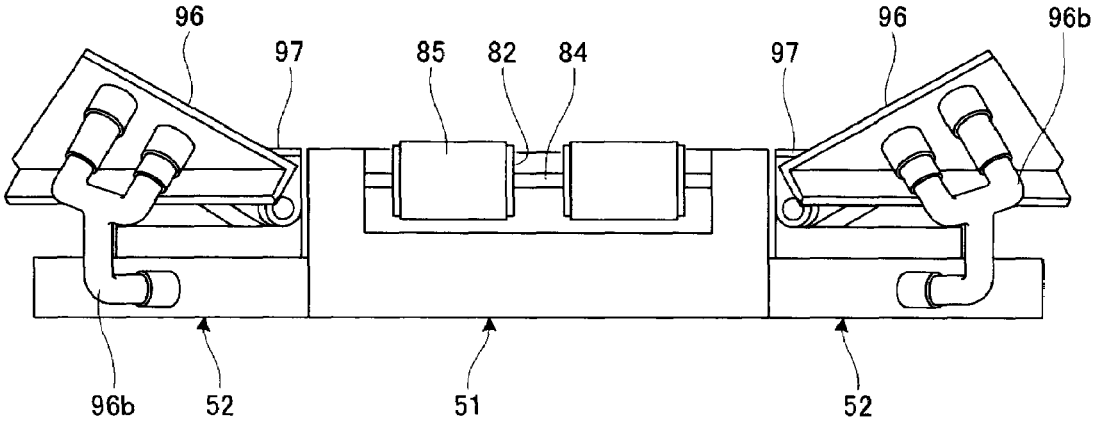
FIG. 7 is a front view of FIG. 6.

Further, in the configurations shown in FIGS. 6 and 7, the tilted guide plates 96 and the expanded guide plates 97 of the jumping boards 52 can slide in the width direction of the sheet as in the foregoing embodiment. Moreover, suction holes **96*a* and 97*a* are formed on the tilted guide plates 96 and the expanded guide plates 97, the suction holes 96*a* of the tilted guide plates 96 are caused to communicate with the suction boxes 91 through flexible tubes 96*b* such as a pleated flexible tube, and air is sucked by the suction boxes 91 through the suction holes 96*a* and 97*a***, so that the curling corrector is realized.

In the paper ejecting device 5 of the foregoing embodiment, the paper suction transport belt 95 composing a part of the paper transport surface of the jumping board 52 moves with the sheet, thereby realizing the friction reducer for reducing friction on the paper transport surface of the jumping board 52.

However, the friction reducer may be realized by using, for example, a low-friction material such as resin for members such as the tilted guide plate 96 and the expanded guide plate 97 which compose the paper transport surface. Further, the friction reducer may be realized by coating the surfaces of members such as the tilted guide plate 96 and the expanded guide plate 97 with a publicly known low-friction material such as polytetrafluoroethylene (PTFE).

Figure 8A:
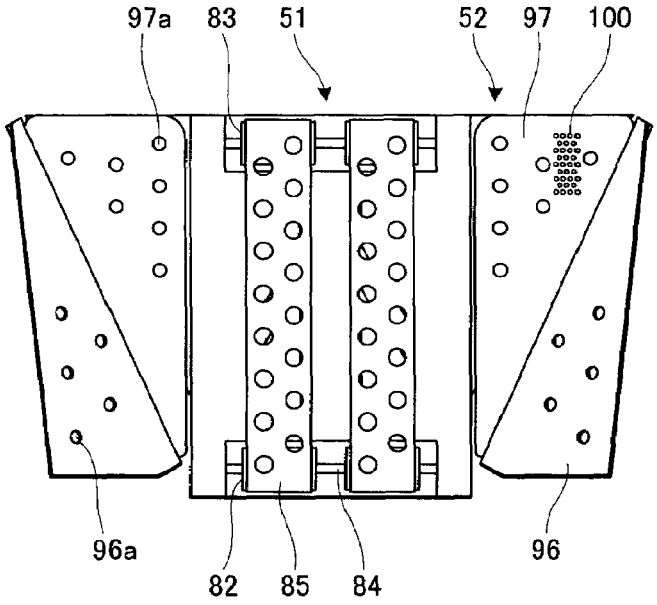
FIG. 8A is a plan view showing a paper ejecting device according to another embodiment of the present invention.
Figure 8B:
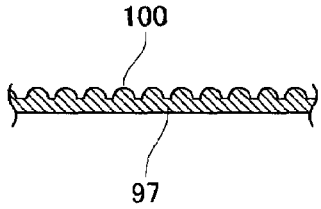
FIG. 8B is a main part enlarged view showing the paper ejecting device according to this embodiment of the present invention.

Furthermore, as shown in FIGS. 8A and 8B, the friction reducer may be realized by forming a plurality of protrusions 100 or concave and convex portions (not shown) on the paper transport surface of the paper ejecting device 5 to reduce a contact area between the paper transport surface and the sheet. The protrusions 100 or the concave and convex portions (not shown) may be formed with an expanded area or may be formed in rows along the transport direction of the sheet.

Figure 9A:
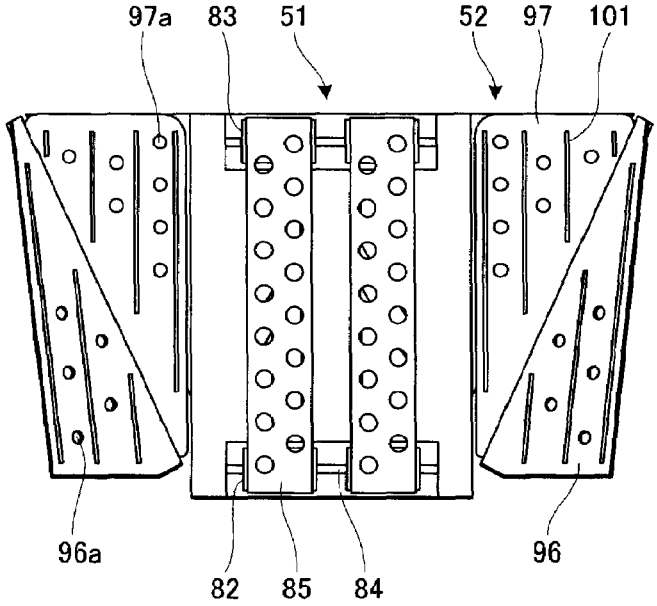
FIG. 9A is a plan view showing a paper ejecting device according to another embodiment of the present invention.
Figure 9B:
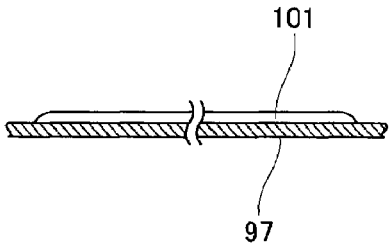
FIG. 9B is a main part enlarged view showing the paper ejecting device according to this embodiment of the present invention.

Moreover, as shown in FIGS. 9A and 9B, the friction reducer may be realized by forming a plurality of ribs 101 on the paper transport surface of the paper ejecting device 5 along the transport direction of the sheet to reduce a contact area between the paper transport surface and the sheet.

Figure 10A:
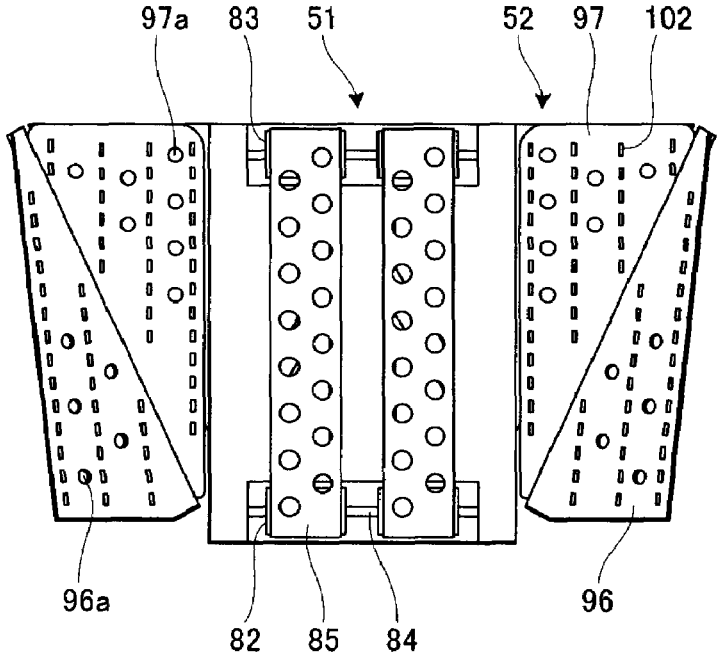
FIG. 10A is a plan view showing a paper ejecting device according to another embodiment of the present invention.
Figure 10B:
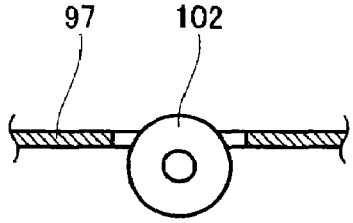
FIG. 10B is a main part enlarged view showing the paper ejecting device according to this embodiment of the present invention.

Further, as shown in FIGS. 10A and 10B, the friction reducer may be realized by providing a plurality of rollers 102 on the paper transport surface of the paper ejecting device 5 to have rolling friction.

What is claimed is:

1. A paper ejecting device, comprising:

a body having suction transport belts for transporting a sheet of paper along a paper transport surface of the body by suction;

jumping boards provided on both sides of the body along a paper transport direction; and a curling corrector for correcting a shape of the sheet along paper transport surfaces of the jumping boards, wherein the curling corrector is made up of a sucker for sucking the sheet on the paper transport surface of the jumping board.

2. The paper ejecting device according to claim 1, wherein the jumping board has a friction reducer on the paper transport surface, the friction reducer reducing friction with the sheet, and the friction reducer is made up of a plurality of rollers provided on the paper transport surface of the jumping board.

3. The paper ejecting device according to claim 1, wherein the jumping board has a friction reducer on the paper transport surface, the friction reducer reducing friction with the sheet, and the friction reducer is made up of a suction transport belt for transporting the sheet along a paper transport surface of the suction transport belt by suction.

4. The paper ejecting device according to claim 1, wherein the curling corrector is made up of an air blower for blowing air so as to press the sheet to the paper transport surfaces of the jumping boards.

5. The paper ejecting device according to claim 4, wherein the air blower blows air from a center of the sheet to both ends of the sheet, the ends being disposed in parallel with the paper transport direction.

6. The paper ejecting device according to claim 3, wherein the body and the friction reducer can adjust transport speeds of the suction transport belts.

7. The paper ejecting device according to claim 1, wherein in the curling corrector, the sucker is made up of an air sucker capable of adjusting an air suction force.

8. The paper ejecting device according to claim 1, wherein the jumping board has the paper transport surface which can be tilted at any angle relative to the paper transport surface of the body and can be moved to any position in a direction orthogonal to the paper transport direction.

9. A paper ejecting device, comprising:

a body having suction transport belts for transporting a sheet of paper along a paper transport surface of the body by suction;

jumping boards provided on both sides of the body along a paper transport direction; and a curling corrector for correcting a shape of the sheet along paper transport surfaces of the jumping boards, wherein the curling corrector is made up of an air blower for blowing air so as to press the sheet to the paper transport surfaces of the jumping boards.

10. The paper ejecting device according to claim 9, wherein the air blower blows air from a center of the sheet to both ends of the sheet, the ends being disposed in parallel with the paper transport direction.

* * * * *